United States Patent [19]

Ramos et al.

[11] 4,169,973

[45] Oct. 2, 1979

[54] BOUNCE-RESISTANT CONTACTS FOR A SWITCH

[75] Inventors: Joel A. Ramos, Chicago; Roy T. Swanson, North Riverside, both of Ill.

[73] Assignee: S & C Electric Company, Chicago, Ill.

[21] Appl. No.: 956,463

[22] Filed: Oct. 30, 1978

[51] Int. Cl.[2] ..... H01H 1/50; H01H 3/60

[52] U.S. Cl. ..... 200/256; 200/258; 200/288

[58] Field of Search ..... 200/254, 255, 256, 258, 200/288, 144 R, 282

[56] References Cited

U.S. PATENT DOCUMENTS

| | | | |
|---|---|---|---|
| 1,988,687 | 1/1935 | Jackson | 200/282 |
| 2,221,607 | 11/1940 | Samzelius | 200/282 |
| 2,433,115 | 12/1947 | Green | 200/255 |
| 2,760,034 | 8/1956 | Kowalski et al. | 200/255 |
| 2,779,844 | 1/1957 | Kowalski | 200/258 |
| 3,087,039 | 4/1963 | Bachman | 200/254 |
| 3,676,629 | 7/1972 | Evans et al. | 200/254 |

*Primary Examiner*—Steven L. Stephan
*Attorney, Agent, or Firm*—John D. Kaufmann

[57] ABSTRACT

A bounce- and weld- resistant contact assembly includes a pair of spaced contact plates with facing contacts on their ends. A switch blade is rapidly movable into and out of engagement with the contacts. The contacts are convexities coined into the plates which add no mass to the plates. Thus, the natural frequency of the plates is maximized and the magnitude of oscillation of the plates, when the contacts are rapidly engaged by the blade, is minimized. Legs on leaf springs act against concavities formed in the plates opposite the convexities. The legs conformally nestle in the convexities so that their frictional engagement therewith and the spring force co-act to quickly damp the high frequency, low magnitude oscillations of the plates. The low mass coined contacts also permit close spacing of the plates to maximize magnetic forces thereon due to current flow therethrough. These forces aid the spring and the leg-concavity friction in quickly damping oscillations of the plates.

10 Claims, 5 Drawing Figures

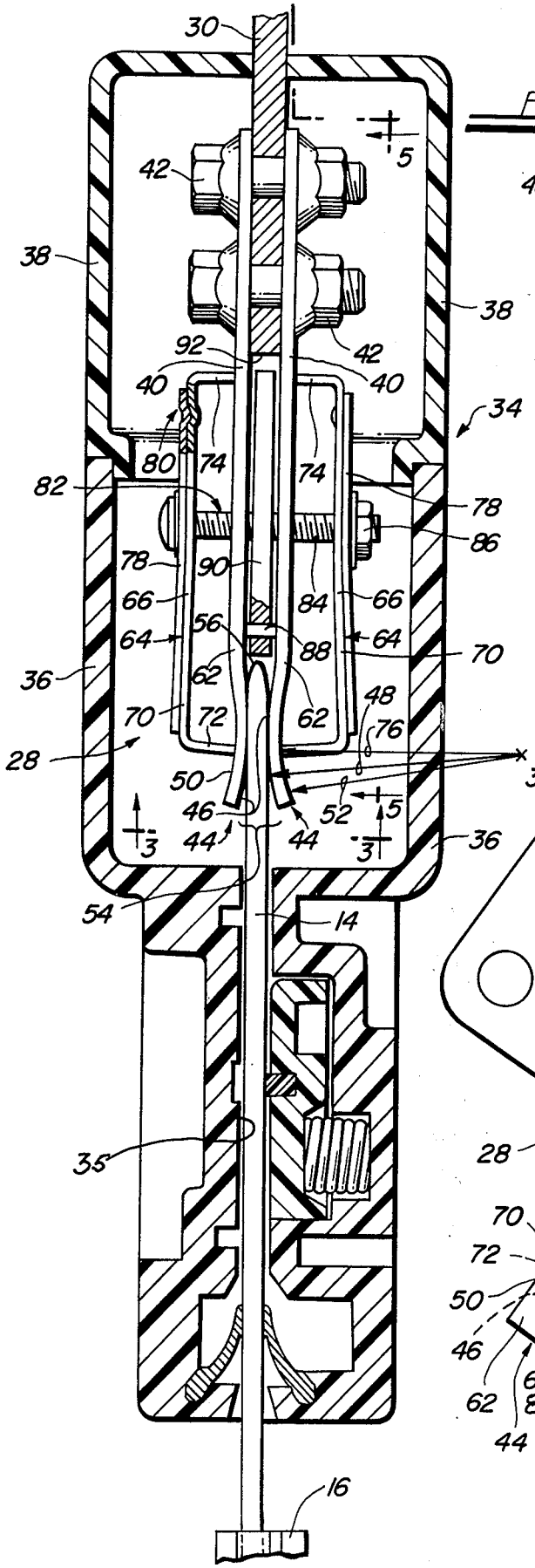
FIG-2
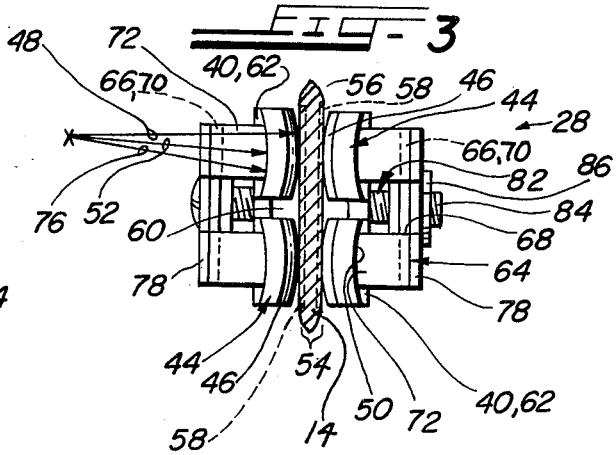
FIG-3
FIG-5
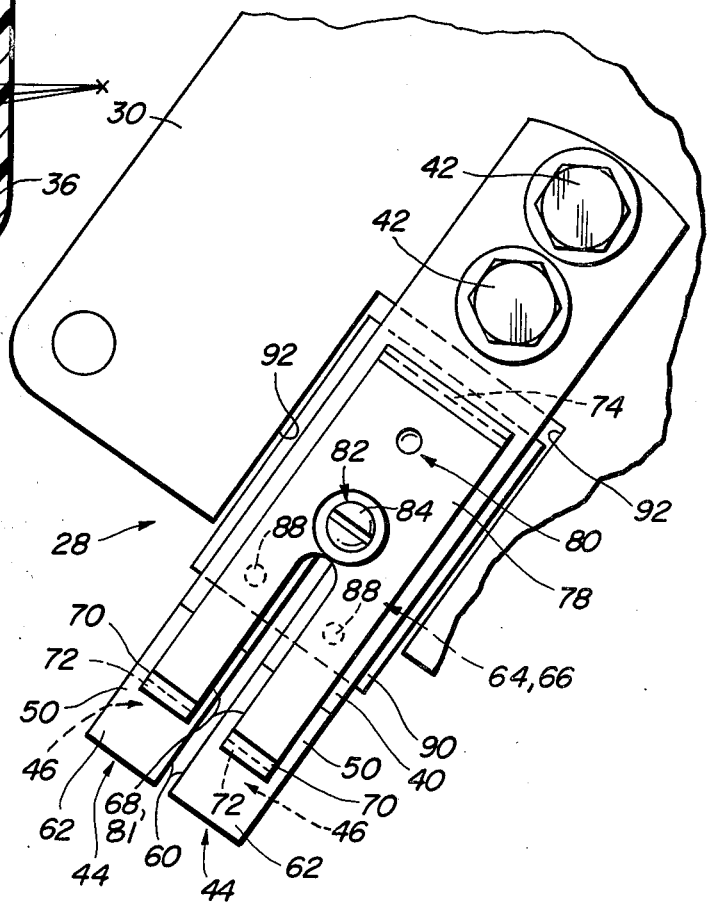

BOUNCE-RESISTANT CONTACTS FOR A SWITCH

FIELD OF THE INVENTION

This invention relates to improved bounce-resistanct contacts for a switch, and more particularly to improved bounce- and weld-resistant contacts for use in a high-voltage switch, such as a circuit interrupter. The present invention represents an improvement over the switch construction disclosed in commonly-assigned, U.S. Pat. No. 3,676,629 to Evans and Swanson. The present invention is also an improvement over the switch contacts disclosed in U.S. Pat. No. 2,779,844 to Kowalski.

DISCUSSION OF THE PRIOR ART

U.S. Pat. No. 3,676,629 relates to a switch construction with non-bounce contacts. A switch blade, having a beveled leading edge, is movable into and out of engagement with massive contacts having large-radius, circular contact surfaces. The contacts are respectively mounted to the distal ends of a pair of elongaged contact plates; each plate includes a rigidifying rib. The contact plates are mounted to a support terminal bracket at their proximal ends. An equalizer passing through the contact plates about mid-way between the support terminal bracket and the contacts bends a pair of L-shaped springs mounted on the outside of the contact blades. Long legs of the L-shaped springs apply force to the contact plates to space the contacts apart a distance slightly less than the thickness of the switch blade. This spacing is maintained by a spacer pin held between the contact plates by an insulative member which is attached to the support terminal bracket by the equalizer. The equalizer takes the form of a bolt having a nut at one end thereof. Appropriate threading of the nut onto the bolt bends the springs so that a predetermined amount of force is applicable by the springs.

The switch blade is moved into and out of engagement with the contacts at high speed by an appropriate operating mechanism. The mass of the contacts and the force of the spring are so related to the velocity of the switch blade that bouncing of the contacts is minimized, and the circuit is completed sufficiently rapidly so that arcing and welding are also minimized up to certain current levels. The entire contact assembly is enclosed in an insulating, arc-extinguishing housing.

Notwithstanding the premise of the U.S. Pat. No. 3,676,629 invention (the mass of the contacts, the spring force, and the blade velocity are related so as to minimize both bouncing and welding, with an eye to current levels in the blade and the contacts) it has been found that the high mass of such contacts may permit the contact plates to oscillate too much and, accordingly, may cause the contacts to bounce more than desired in certain situations. Specifically, if, because of high blade speeds and magnetic forces due to high fault currents, the contacts begin to oscillate, the high mass contacts do not effectively prevent oscillations thereof from continuing and, accordingly, intolerable contact bounce may occur. That is, the amount of bounce and concomitant welding may be intolerable at higher current levels. Moreover, the cost of the prior contact assembly, especially as it relates to the fabrication and assembly thereof, has been found to not be optimal. For example, the massive contacts are made of a copper and are attached to the contact plates by headed extensions; the contact plates contain rigidifying ribs for mechanical strength. Additionally, the L-shaped leaf springs must be located and held (as in a fixture) as the equalizer is tightened; the L-shaped leaf springs are maintained in their proper position only by the equalizer and by furcations at the end thereof which surround the headed extensions. All of these constructional and assembly characteristics add to the cost of the contacts.

Also, the size of contacts practically requires that the contact plates be spaced rather far apart. As a consequence the magnetic effect of currents flowing through the blade and the plates are not nearly as effective as they might be in preventing or damping oscillations of the plates.

In Kowlaski U.S. Pat. No. 2,779,844, a portion of a pivotable and rotatable switch blade engages in the switch closed position, a contact assembly. The contact assembly includes a pair of inside fingers and a pair of outside fingers, both of which are attached to a mounting. The fingers terminate in arcuate contact areas which are selectively engaged and disengaged by the blade as it moves. The contact areas are urged against the switch blade by a complicated leaf-spring assembly which has tension applied thereto by a tie bar connected therebetween. The gap between the contact areas is set by a spacer pin which maintains the arcuate surfaces a distance apart which is only slightly smaller than the width of the switch blade in the closed position.

The leaf spring assembly applies force to the arcuate contact surfaces through a complexly-shaped and constructed equalizer which is pivotally mounted to the longest leaf spring of the leaf spring assembly and which contains a pair of arms terminating in rounded surfaces which ride against what appear to be low-friction back-up pads on the fingers located opposite the arcuate contact surfaces.

The Kowalski device is quite expensive to manufacture and to assemble.

Accordingly, a primary objective of the present invention is to provide a non-bounce, non-welding contact assembly for use in a high-voltage switch which is simple and inexpensive to manufacture and easy to adjust, and which represents an improvement of both the above-mentioned patents, particularly at higher current levels.

SUMMARY OF THE INVENTION

According to the present invention, there is provided an improved non-welding, non-bouncing contact assembly for use in a high-voltage switch. The switch is of a known type, and includes a blade movable into and out of engagement with the contact assembly. The contact assembly is of the general type having a pair of opposed, elongated contact plates containing opposed contacts at their distal ends for receiving the blade therebetween. Leaf springs are also provided for biasing the contacts together. Moreover, an equalizer maintains the leaf springs under tension, and a spacer limits the extent of movement of the contacts together.

In accordance with the improvement of the present invention, the contacts are convexities, preferably spherical, formed in the distal ends of the plates. Concavities, preferably spherical, are also formed in each plate opposite from and preferably concentric with the respective convexities. Legs on the leaf spring have ends which act against the respective concavities along the common axis of the convexities and the concavities. Each leg end has a rounded shape which nestles in and frictionally engages its respective concavity to maintain the legs in position (during and after assembly) and to damp any oscillatory motion of the plate as the blade rapidly engages the contacts. Preferred embodiments of the leaf springs include central, elongaged spring portions which are generally parallel to each plate. The central portions each have one of the legs perpendicularly carried thereon. The spacer and the equalizer are so positioned that the contacts have a first pivoting radius about the pin which is positioned between the contact plates. The springs have a second pivoting radius about the equalizer which passes through the plates and the leaf springs. The second pivoting radius is longer than the first pivoting radius. Accordingly, joint flexing of the plates and of the central portions of the springs due to engagement of the contacts by the blade causes relative frictional sliding between the leg ends and the concavities due to the different pivoting radii. This frictional sliding effects the damping of oscillatory movement of the contacts and of the contact plates.

The convexities are coined into the plates and constitute the entirety of the contacts. As a consequence, there is no additional mass added to the plates which therefore have their mass minimized to increase the natural frequency of the contact plates. This both minimizes the mganitude of oscillatory motion of the plates as the blade rapidly engages the contacts and permits the oscillations to be damped at a faster rate. The coining of the contacts permits the plates to be closer together than in prior art devices. Accordingly, the magnetic field generated by current flow as the blade engages the contacts is more effective in pulling the plates together to aid in preventing or damping oscillations of the plates. Lastly, passage of the equalizer through the central spring portions and through the plates, as well as the engagement of the legs and the concavities, fixes the relative positions of the leaf springs and the plates during assembly thereof rendering such assembly convenient and easy to effect.

BRIEF DESCRIPTION OF THE DRAWING

FIG. 2 is a detailed, magnified, sectional view taken generally along line 2—2 in FIG. 1, to show more clearly certain features of a contact assembly used in the switch in FIG. 1 in accordance with the principles of the present invention;

FIG. 3 is a magnified view of a portion of the contact assembly taken along line 3—3 in FIG. 2 showing a switch blade engaged with the contact assembly;

FIG. 5 is a side, elevational view of the contact assembly taken along line 5—5 in FIG. 2.

DETAILED DESCRIPTION

The present invention constitutes an improvement over commonly-assigned U.S. Pat. No. 3,676,629 and U.S. Pat. No. 2,779,844. The U.S. Pat. No. 3,676,629 is itself an improvement over the invention disclosed and claimed in commonly-assigned U.S. Pat. No. 2,894,101 to Lindell et al, which employs both a switch operator disclosed in commonly-assigned U.S. Pat. No. 3,563,102 to Bernatt et al and an arc-extinguishing housing disclosed in commonly-assigned U.S. Pat. No. 3,671,697 to Harner et al.

Figure 1:
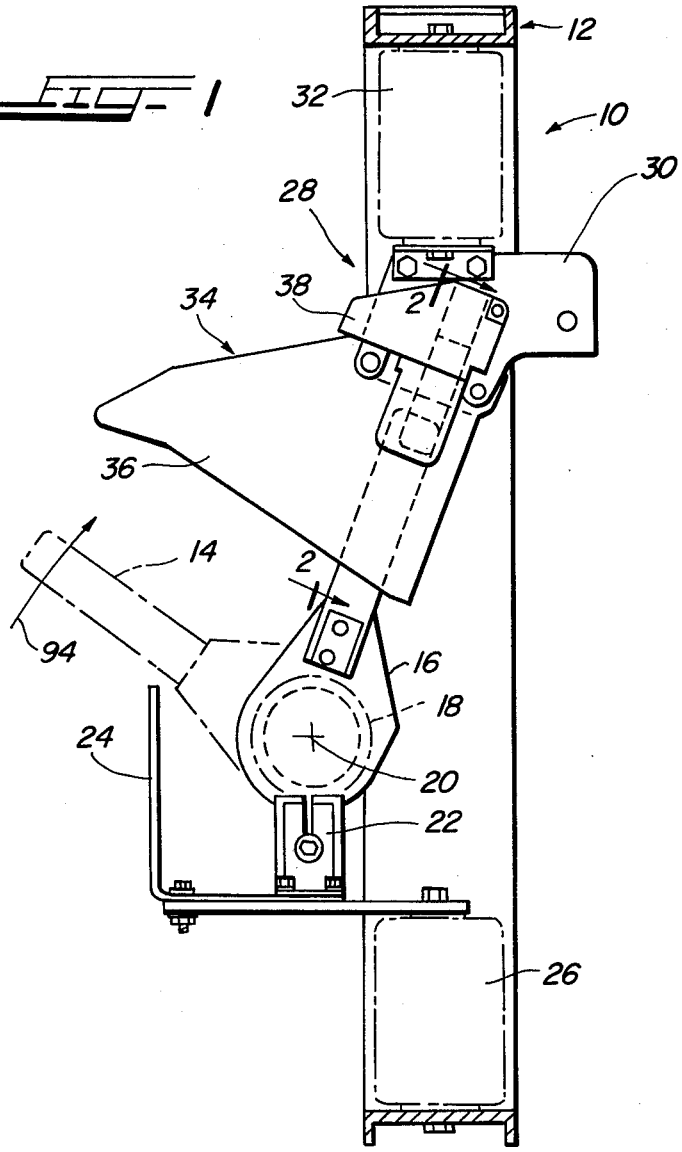
FIG. 1 is a view, in side elevation, showing one phase of a three-phase high-voltage switch utilizing the present invention.

Referring first to FIG. 1, there is shown one phase switch 10 of a three-phase, high-voltage switch, the other two phases of which are not shown. The other two phases may be aligned with the phase switch 10 in a direction perpendicular to the plane of FIG. 1. All three phase switches 10 may be located within a metal housing or cabinet. For a more complete description of this arrangement, see U.S. Pat. No. 3,676,629.

The phase switch 10 is mounted to a metallic frame 12 to which all three phase switches may be commonly mounted. Each phase switch 10 includes a switch blade 14 that is secured to a metallic switch-blade support 16 which is carried by one or more horizontal insulators 18 appropriately mounted to pivot about a horizontal axis 20. Electrical connection to the switch blade support 16 is made by a sliding contact 22 which is mounted on, and secured to, a stationary terminal 24. The stationary terminal 24 is mounted on a stationary lower insulator 26, which is carried by the frame 12.

The phase switch 10 also includes a stationary contact assembly, generally indicated at 28, which constitutes the subject matter of the present invention, the details of which are set forth hereinafter. The stationary contact assembly 28 includes a contact support terminal bracket 30 that is mounted on an upper insulator 32 in any appropriate fashion. The stationary contact assembly 28 is enclosed by an arc-extinguishing housing, generally indicated at 34, which constitutes the subject matter of the Harner et al patent. The arc-extinguishing housing 34 is secured in any convenient fashion to the contact support terminal bracket 30. The insulator 18 and the switch blade 14 are pivoted between the switch opened (solid lines) and the switch closed (phantom lines) positions about the horizontal axis 20 by the switch operator disclosed and claimed in the Bernatt et al patent. The construction of the operator of the Bernatt et al patent and its connection to the insulator 18 is such as to pivot the distal end of the switch blade 14 at a high velocity, such as 28 to 34 ft. per second although other blade velocities are contemplated. Such relatively high velocity of the switch blade 14 minimizes arcing between the distal end of the switch blade 14 and the associated stationary contact assembly 28 when a circuit (not shown), opposed points of which are connected to the stationary terminal 34 and the contact support terminal bracket 30, is closed to pick up a load, an overload or a short circuit. Since the time permitted for arcing is correspondingly reduced by the high speed of the blade 14, there is accordingly a corresponding reduction in erosion that would otherwise take place on both the blade 14 and the stationary contact assembly 28 if the circuit were not closed so rapidly.

The switch blade 14 is arranged to pivot through a slot 35 (FIG. 2) in the arc-extinguishing housing 34. The slot 35, as more completely described in the Harner et al patent, is defined by a pair of plates or covers 36, only one of which is shown in FIG. 1 (See FIG. 2). The stationary contact assembly 28 is located within the plates 36 and a pair of additional plate or cover sections 38 (only one of which is shown in FIG. 1), which may be formed integrally with, or otherwise attached to the plates or covers 36.

Referring now to FIGS. 2–5, it may be seen that the stationary contact assembly 28 includes a pair of contact plates 40 made of a good conducting metal. The contact plates 40 are secured to opposite sides of the contact support terminal bracket 30 by bolts 42 or other fasteners. The contact plates 40 have offset distal ends 44, which include contacts 46. The contacts 46 are concavities, preferably spherical, which are coined or otherwise die-formed in the distal ends 44. Typically, the radius of the concave, spherical contacts 46 is quite large, a radius on the order of approximately 1⅜ inches being typical. This radius is indicated by the reference numeral 48. The contacts 46 are preferably coaxial.

Coaxially formed on each contact plate 40 with the respective contacts 46, are concavities 50, also preferably spherical. The concavities 50 may be formed at the same time and during the same operation that forms the contacts 46. The radius 52 of the concavities 50 is typically on the order of 1¾ inches. Thus, the spherical contacts 46 and the spherical concavities 50 are mutually coaxial and each contact/concavity pair 46/50 is concentric. Because the convexities 46 and concavities 50 are coined and no large mass (as in the U.S. Pat. No. 3,676,629 is added, the plates 40 may be spaced close together for a purpose set forth below.

The contacts 46 define a gap 54 into and out of which the switch blade 14 is moved for engagement with and disengagement from the contacts 46. The switch blade 14 is shown disengaged from the contacts 46 in FIG. 4, and is shown engaged with the contacts 46 in FIG. 3. Because of the spherical shape of the contacts 46, the blade 14 is engaged thereby at opposed points thereof.

The switch blade 14 may have a beveled edge, as indicated at 56 in FIGS. 2 and 3. As the switch blade 14 approaches the contacts 46, the beveled edge 56 is so related thereto that engagement of the blade 14 with the contacts 46 takes place at a relatively shallow angle. Silver inserts 58 (FIG. 3) may be mounted in opposite sides of the switch blade 14 to provide low resistance contact engagement with the contacts 46.

Preferably, the contact plates 40 are slotted, as shown at 60 (FIG. 5), to define a pair of furcations 62. Both furcations 62 on each contact plate 40 preferably have the contacts 46 and the concavities 50 formed therein. Thus, the contact plates 40 define two pair of opposed contacts 46 for engagement with the switch blade 14.

The furcations 62, and thus the four contacts 46, are biased toward each other and into contact engagement with the silver inserts 58 by shallow, generally U-shaped leaf springs, generally indicated at 64. The leaf springs 64 includes elongated central portions 66 which extend along the outside of the contact plates 40 generally parallel thereto. If the contact plates 40 contain the slot 60 forming the furcations 62, the central portions 66 of the leaf springs 64 may also contain a slot, indicated at 68, defining furcations 70. The furcations 70 are generally aligned with the furcations 62.

The leaf springs 64 also include forward legs or extensions 72 and rearward legs or extensions 74. The rearward legs or extensions 74 bear against the contact plates 40 near the bolts 42 and act as a reaction member for the leaf springs 64. The forward legs or extensions 72 bear against the surfaces of the concavities 50 generally along the axes thereof. To this end, the terminus of each forward leg or extension 72 is ground, or otherwise shaped, to have a rounded surface which nestles in its respective concavity 50. Typically, the radius of the surface on the terminus of each forward leg or extension 72 is on the order of 1-23/32 of an inch as indicated by the radius 76. The terminus of each forward leg or extension 72 both conformally nestles in its concavity 50, and slidingly, frictionally moves relative thereto, as described below.

The leaf springs 54 may be used with backup leaf springs 78, held against the outside thereof. To facilitate mounting of the backup leaf springs 78 to the leaf springs 74, and to prevent relative movement therebetween, the leaf springs 64 and 78 may contain mating dimples indicated generally at 80 which lock into each other. The back-up springs 78 may be furcated, by a slot 81 similar to the slot 68 (See FIG. 5).

The leaf springs 64 and 78 are maintained bent by an equalizer 82, which may take the form of a bolt 84 as shown. The bolt 84 extends through aligned clearance holes (not shown) in the leaf springs 64 and 78 and in the contact plates 40. The tightening of a nut 86 on a threaded end of the bolt 84 bends the leaf springs 64 and 78, and accordingly urges the contacts 46 together.

Figure 4:
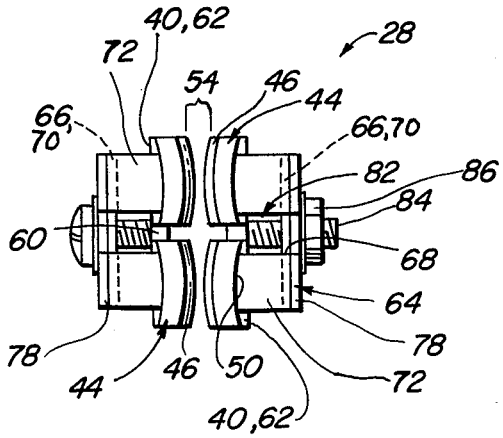
FIG. 4 is a view similar to FIG. 3 which shows the contact assembly before it has been engaged by the switch blade.

Referring again to FIG. 2, and with additional reference to FIGS. 3 and 4, the gap 54 between the contacts 46 maintained by the leaf springs 64 and 78 acted on by the equalizer 82 is slightly less than the thickness of the switch blade 14. In order to maintain this gap 54, a spacer pin 88 is employed. The spacer pin 88 may be made of stainless steel or the like, and is held in position by a rectangular insulating support 90. In the preferred embodiment where the contact plate 40 is bifurcated, the insulating support 90 maintains a pair of spacer pins 88 between each pair of opposed furcations 70. The insulating support 90 may be positioned between the contact plates 40 and may be located in a complimentarily shaped notch 92 formed in the contact support terminal bracket 30. Engagement of the insulative support 90 by the walls of the notch 92 prevents rotation thereof, while permitting the spacer pins 88 to "float" between the contact plates 40. The bolt 84 constituting the equalizer 82 passes through a clearance hole (not shown) in the insulating support 90 to prevent linear movement thereof.

The length of the spacer pins 88 is such that in the absence of the switch blade 14 from the vicinity of the contacts 46, the gap 54 between the contacts 46 is maintained at a distance slightly less than the thickness of the switch blade 14. Comparing FIGS. 3 and 4, if the switch blade 14 has moved to the closed position (FIG. 3), the contacts 46 are moved slightly apart against the biasing action of the leaf springs 64 and 78. At this time, the full spring force of the leaf springs 64 and 78 is exerted against the contacts 46 to provide corresponding pressure thereof against the switch blade 14 and the silver inserts 48 therein.

In fabricating and adjusting a commercial embodiment of the present invention where the switch 10 is rated for continuous current of 600 amperes, the bolt 84 constituting the equalizer 82 and the nut 86 thereon are tightened until the gap 54 is approximately 0.075 inch. Subsequently, the bolt 94 and the nut 86 are readjusted with a test fixture in the gap 54 until the pressure of the contacts 46 on the test fixture is 38 pounds, plus or minus 2 pounds, with a gap 54 being maintained at approximately 0.125 inch by the test fixture. When the test fixture is removed from the gap 54, the contacts 46, which now move back toward each other, must be spaced apart from 0.060 to 0.080 inch. The switch blade 14 is approximately 0.125 inch thick.

In operation, the switch blade 14 is pivoted in the direction indicated by arrow 94 (see FIG. 1) by the operator at high velocity. As the switch blade 14 approaches the contacts 46, under such conditions that current flow at a relatively high voltage is to be established, there is a tendency for an arc to form between the advancing beveled edge 46 of the switch blade 14 and one or the other or both of the contacts 46. The time for arc initiation to positive mechanical engagement between the switch blade 14 and the contacts 46 is approximately one millisecond if the arc is established at a voltage crest. This represents approximately ¼ of the time for the current to reach its maximum value. If the current is established at a voltage zero, the time will be less than ⅓ of a millisecond. As previously noted, because of the beveled edge 56 on the switch blade 14, and the large radius 48 of the contacts 46, engagement between the switch blade 14 and the contacts 46 takes places at a relatively shallow angle. There is further blade travel after the time of positive mechanical contact, but during this time, the contact is a sliding contact between the blade 14 and the contacts 46 and little or no arcing exists if the contacts 46 do not bounce. The total time from arc initiation until the switch blade 14 reaches the fully closed position shown in FIGS. 2 and 3, is four to five milliseconds or approximately ¼ cycle at 60 hertz.

The switch 10 constructed as described above, is capable of closing on a high-voltage circuit (5,000 volts or more) with a high current available (40,000 amperes or more). For example, the switch construction disclosed herein is capable of closing on a 40,000 ampere fault at from 14.4–25 kV two times and still carry rated continuous current on the order of 400–600 amperes. Also, the switch 10 is capable of closing on a 40,000 ampere fault at the same voltage twice and still carry and interrupt the rated continuous current. The mounting of the stationary contact assembly 28 within the arc extinguishing housing 34 decreases the violence of a fault closing operation to a level which minimizes damage to the phase switch 10 and to other equipment in its vicinity. Also, this construction permits opening the circuit and rapid extinguishment of any arc incident thereto.

An important feature of the present invention is reduction to a minimum of transient mechanical oscillations incident to the switch closing operation. This is achieved by the use of the leaf springs 64 and 78, by the low mass of the contacts 46, by the close spacing of the plates 40 and by the frictional sliding engagement between the terminus of the forward legs or extensions 72 on the contacts 50. Specifically, the tensioning of the leaf springs 64 and 78 by the equalizer 82 applies a constant high force to the contacts 46 along the axis thereof by the forward legs or extensions 72. This force application tends to damp out or prevent mechanical oscillations of the furcations 62 when the switch blade 14 engages the contacts 46. Because the contacts 46 are formed by a simple coining or stamping operation, and involve the addition of no mass thereto, in contrast to the U.S. Pat. No. 3,676,629, the mass thereof is kept to a minimum, considering the current carrying capacity thereof. As a consequence, the natural freqency of the entire mechanical system which includes the furcations 62 is increased over that shown in the U.S. Pat. No. 3,676,629. This increase in the natural frequency with its concomitant decrease in amplitude tends to minimize the bouncing or mechanical oscillations of the contacts 46 as they are engaged at high speed by the switch blade 14. Oscillations which do tend to occur are easily and quickly damped by the springs 64 and 78. It will also be noted that, with respect to the contacts 46, the furcations 62 pivot about a pivot point represented by the spacer pin 88, as pivoting radius being defined between such spacer pin 88 and the contacts 46. The central portions 66 of the leaf spring 64, on the other hand, pivot about the equalizer 82, the pivoting radius being defined between the bolt 84 thereof and the forward legs or extensions 72. The pivoting radius for the forward extensions or legs 72 is longer than the pivoting radius for the contacts 46. As a consequence, when flexing of the furcations 62 and of the leaf springs 64 occurs due to rapid engagement of the contacts 46 by the switch blade 14, some relative sliding frictional movement between the rounded terminus of each forward leg or extension 72 and its conformally engaged, preferably spherical, concavity 50 occurs. This sliding frictional engagement, which involves the edges of the termini digging or biting into the concavities, dissipates energy and tends to damp or prevent mechanical oscillations of the contacts 46 and, accordingly, bounce of such contacts 46. Lastly, because the contacts 46 are coined, the plates 40 may be spaced closely together, as shown. Thus, as the blade 14 engages the contacts 46, current flow generates a magnetic field which is very effective in pulling the closely spaced plates 40 together further preventing or damping oscillations therein in aid of the springs 64 and 78. The contact assembly 28 can move slightly from side to side as a unit. As a consequence, large asymmetric magnetic forces due to high (e.g., fault) currents flowing as the switch blade 14 attempts to engage the contacts 46 are unable to cause unbalanced pressure on opposite sides of the switch blade 14 by the contacts 46. Because the contact plates 40 are preferably longer than the leaf springs 64 and 78, such contact plates 40 cannot apply a large force on the contacts 46. Accordingly, the force applied by the contacts 46 to opposite sides of the switch blade 14 is determined primarily by the leaf springs 64 and 78. Thus, a significant change in contact force by the contacts 46 against the blade 14 does not occur if the contact plates 40 are bent or annealed by either magnetic forces due to high current flowing therein, or heat generated by such currents, or by arcs.

As is well known, auxiliary contact fingers (not shown) may be attached to the contacts 46 in advance thereof. During a closing operation, any arc that is established to the switch blade 14 terminates on such auxiliary contacts rather than on the contacts 46. As a result, no initial arcing takes place between the switch blade 14 and the contacts 46, thus increasing the life of such contacts 46.

The above described embodiments of the present invention are simply illustrative of the principles thereof. Various other modifications and changes may be devised by those skilled in the art which embody the principles of this invention yet fall within the spirit and scope thereof.

What is claimed is:

1. An improved bounce-resistant contact assembly for use in a high-voltage switch; the switch including a blade movable into and out of engagement with the contact assembly; the assembly being of the type having (a) a pair of opposed, elongated contact plates with opposed contacts at their distal ends for receiving the blade therebetween, (b) leaf spring means for biasing the contacts together, (c) an equalizer for maintaining the leaf spring means under tension, and (d) spacer means for limiting the extent of movement of the contacts together; wherein the improvement comprises:

the contacts being spherical convexities formed in the plates; and which further comprises a spherical concavity formed in each plate opposite from and concentric with its respective convexity, and legs on the leaf spring means, an end of each leg acting against a respective concavity along the axis of the convexities and the concavities, each end having a rounded shape which nestles in and frictionally engages its respective concavity to maintain the legs in position along the axis and to damp oscillatory motion of the plates as the blade rapidly engages the contacts.

2. An assembly as recited in claim 1, wherein the spacer means is a pin between the plates, the contacts having a first pivoting radius about the pin; and the equalizer is a rod passing through the plates and the leaf spring means, the spring having a second pivoting radius about the rod longer than the first pivoting radius; wherein the improvement further comprises:

the leaf spring means including a central elongaged spring portion generally parallel to each plate and through which the rod passes, each central portion having one of the legs perpendicularly carried thereon, flexing of the plates and of the central portions respectively about the pin and the rod causing relative, frictional sliding between the spherical ends and the spherical concavities due to the differing pivoting radii.

3. An assembly as recited in claim 2, wherein the convexities are coined into the plates and constitute the entirety of the contacts, there being no additional mass added to the plates so that the mass thereof is minimized increasing the natural frequency thereof to minimize oscillatory motion of the plates as the blade rapidly engages the contacts.

4. An assembly as recited in claim 3, wherein the leaf spring means defines a shallow U and further includes an extension on each central portion generally parallel to its respective legs, the extensions being against the plates on a side of the pin opposite from the side thereof on which the legs are located to serve as reaction members for the central portions.

5. An assembly as recited in claim 4, wherein the passage of the rod through the central portions and the plates and the engagement of the legs and the concavities fix the relative positions of the leaf spring means and the plates during assembly thereof.

6. An improved non-welding, non-bouncing contact assembly for use in a high-voltage switch, the switch including a blade movable into and out of engagement with the contact assembly; the contact assembly and the blade being connectable to opposed points of a high-voltage circuit; wherein the improvement comprises:

a pair of opposed contact members defining therebetween a gap into and out of which the blade is movable;

a spherical convexity on each member within the gap, the blade moving into and out of engagement with the convexities as it moves into and out of the gap;

a spherical concavity on each member concentric with the convexity thereon;

means acting along the axes of concentricity of the respective convexities and concavities for biasing the convexities together so that the axial distance therebetween is less than the thickness of the blade the biasing means including a leg having an end engaging each concavity, the end having a rounded surface frictionally, slidingly engaging the concavity; and means remote from the convexities for maintaining a minimum distance between the members.

7. A contact assembly as recited in claim 6, wherein the biasing means biases the members together remote from the convexities and on the opposite side of the maintaining means from the action of the biasing means on the convexities.

8. An improved bounce-resistant contact assembly for use in a high-voltage switch; the switch including a blade movable into and out of engagement with the contact assembly; the assembly being of the type having (a) a pair of opposed, elongated contact plates with opposed contacts at their distal ends for receiving the blade therebetween, (b) leaf spring means for biasing the contacts together, (c) an equalizer for maintaining the leaf spring means under tension, and (d) spacer means for limiting the extent of movement of the contacts together, wherein the improvement comprises:

the contacts being spherical convexities coined into the plates, the convexities constituting the entirety of the contacts so that no additional mass is added to the plates and the mass thereof is minimized to increase the natural frequency thereof, thereby minimizing oscillatory motion of the plates as the blade rapidly engages the contacts;

the plates being sufficiently close together so that magnetic forces generated by current flowing through the blade, the contacts and the plates are effective to pull the plates together, thereby minimizing oscillatory motion of the plates; the assembly further comprising a spherical concavity in each plate opposite from and concentric with its respective convexity; and a leg on each leaf spring means an end of each leg having a rounded shape which conformally nestles in and frictionally engages its respective concavity to act thereagainst along the axis of the convexities and the concavities, so that the legs are maintained along the axis and damp oscillatory motion of the plates.

9. An improved bounce-resistant contact assembly for use in a high-voltage switch; the switch including a blade movable into and out of engagement with the contact assembly; the assembly being of the type having (a) a pair of opposed, elongated contact plates with opposed contacts at their distal ends for receiving the blade therebetween, (b) leaf spring means for biasing the contacts together, (c) equalizer for maintaining the leaf spring means under tension, and (d) spacer means for limiting the extent of movement of the contacts together; wherein the improvement comprises:

the contacts being convexities formed in the plates; and which further comprises a concavity formed in each plate opposite from its respective convexity, and legs on the leaf spring means, an end of each leg acting against its respective concavity, each end having a rounded shape which nestles in and frictionally engages its respective concavity to maintain the legs in position and to damp oscillatory motion of the plates as the blade engages the contacts.

10. An improved bounce-resistant contact assembly for use in a high-voltage switch; the switch including a blade movable into and out of engagement with the contact assembly; the assembly being of the type having (a) a pair of opposed, elongated contact plates with opposed contacts at their distal ends for receiving the blade therebetween, (b) lead spring means for biasing the contacts together, (c) an equalizer for maintaining the leaf spring means under tension, and (d) spacer means for limiting the extent of movement of the contacts together; wherein the improvement comprises:

the contacts being convexities coined into the plates, the convexities constituting the entirety of the contacts so that no additional mass is added to the plates and the mass thereof is minimized to increase the natural frequency thereof, thereby minimizing oscillatory motion of the plates as the blade rapidly engages the contacts;

the plates being sufficiently close together so that magnetic forces generated by current flowing through the blade, the contacts and the plates are effective to pull the plates together, thereby damping oscillatory motion of the plates; the assembly further comprising a concavity in each plate opposite from its respective convexity; and a leg on each leaf spring means, an end of each leg having a rounded shape which conformally nestles in and frictionally engages its respective concavity to act thereagainst, so that the legs damp oscillatory motion of the plates.

* * * * *